US008412068B2

(12) United States Patent
Nishimura et al.

(10) Patent No.: US 8,412,068 B2
(45) Date of Patent: Apr. 2, 2013

(54) COOLING DEVICE INCLUDING A WATER-ABSORBING MEMBER AND IMAGE FORMING DEVICE

(75) Inventors: Takayuki Nishimura, Tokyo (JP); Kenichi Takehara, Kanagawa (JP); Yasuaki Iijima, Kanagawa (JP); Hiromitsu Fujiya, Kanagawa (JP); Satoshi Okano, Kanagawa (JP); Tomoyasu Hirasawa, Kanagawa (JP); Masanori Saitoh, Tokyo (JP); Shingo Suzuki, Kanagawa (JP); Takahiro Ogino, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 232 days.

(21) Appl. No.: 12/860,174

(22) Filed: Aug. 20, 2010

(65) Prior Publication Data

US 2011/0052248 A1 Mar. 3, 2011

(30) Foreign Application Priority Data

Aug. 28, 2009 (JP) ..... 2009-198356
Aug. 28, 2009 (JP) ..... 2009-198359

(51) Int. Cl.
*G03G 21/20* (2006.01)

(52) U.S. Cl. ..... 399/94; 399/341

(58) Field of Classification Search ..... 399/94, 399/341

See application file for complete search history.

(56) References Cited

U.S. PATENT DOCUMENTS

| | | | | |
|---|---|---|---|---|
| 6,082,854 | A * | 7/2000 | Axtell et al. | |
| 6,501,500 | B1 * | 12/2002 | Olenio et al. | |
| 7,398,028 | B2 * | 7/2008 | Nakagaki | |
| 7,552,581 | B1 * | 6/2009 | Pfeifer et al. | |
| 2002/0085855 | A1 * | 7/2002 | Baughman | |
| 2006/0210333 | A1 * | 9/2006 | Kakishima et al. | 399/341 |
| 2009/0269099 | A1 * | 10/2009 | Takehara | 399/94 |
| 2010/0008695 | A1 * | 1/2010 | Okano et al. | 399/94 |
| 2010/0129107 | A1 | 5/2010 | Takehara et al. | |
| 2010/0183323 | A1 | 7/2010 | Fujiya et al. | |

FOREIGN PATENT DOCUMENTS

| | | | |
|---|---|---|---|
| GB | 2311028 | A * | 9/1997 |
| JP | 10-207155 | | 8/1998 |
| JP | 2006-3628 | | 1/2006 |
| JP | 2009-265489 | | 11/2009 |

* cited by examiner

*Primary Examiner* — David Gray
*Assistant Examiner* — Laura Roth
(74) *Attorney, Agent, or Firm* — Oblon, Spivak, McClelland, Maier & Neustadt, L.L.P.

(57) ABSTRACT

A cooling device is disclosed. The cooling device includes a cooling section which is moveably provided with respect to an image forming device body between a first location and a second location, the second location being different from the first location, and which cools surroundings with a cooling medium to be supplied; a cooling medium supply section which is provided at the image forming device body and which cools the cooling medium to supply the cooled cooling medium to the cooling section; and a connecting member which connects the cooling section and the cooling medium supply section to circulate the cooling medium between the cooling section and the cooling medium supply section, wherein the connecting member includes a flexible member and is supported by a guiding member which guides an operation of tracking the connecting member in conjunction with movement of the cooling section.

8 Claims, 14 Drawing Sheets

COOLING DEVICE INCLUDING A WATER-ABSORBING MEMBER AND IMAGE FORMING DEVICE

TECHNICAL FIELD

The present invention relates to a cooling device having a cooling section which is provided movably with respect to the body of an image forming device, and the image forming device provided with the cooling device.

BACKGROUND ART

There is an image forming device such as a copier, a printer, a facsimile machine, or a multi-functional unit having these functions, which is provided with a cooling device for cooling a device provided around a device which liberates heat (e.g., a fixing device). For example, Patent document 1 discloses an image forming device provided with a liquid-cooling type cooling device for cooling a process unit that is removable with respect to the body of the image forming device.

Moreover, in recent years, for the purpose of improving printing speed, amount of heat provided to paper at the time of image fixing is increasing, so that paper curling as well as a phenomenon, so-called blocking, in which softened toner sticks to a different sheet of paper is becoming more likely to occur. Thus, in order to prevent these drawbacks, paper discharged from the fixing device is cooled by the cooling device. For example, Patent document 2 discloses an image forming device having a heat pipe as a unit for cooling paper.

In general, for maintenance and paper jamming processes, a fixing device and a process unit, etc., are arranged so that they can be pulled out with respect to the image foaming device body. Moreover, it is desired that the maintenance and paper jamming processes are conducted after cooling the fixing device with the cooling device since the fixing device has reached high temperature immediately after disabling, etc. Similarly, as the process unit, etc. could also have heated up due to receiving heat from the fixing device, it is preferable to conduct the maintenance and paper jamming processes after cooling.

However, in case of the image forming device disclosed in Patent document 1, pulling out the process unit separates a cooling pipe provided at the process unit and a circulation pump provided at the image forming device body, so that cooling is not conducted in such a state. Therefore, when conducting maintenance, etc., it is likely that the process unit remains at high temperature, so that touching the process unit may be dangerous. Moreover, a cooling liquid which remains at a connecting section (a separating section) dropping into the image forming device at the time of separating the cooling pipe and the circulation pipe may detrimentally affect subsequent image forming. Furthermore, when a contaminant such as toner or paper powder that scatters within the device fixes to the cooling liquid which remains in the connecting section (separating section), the contaminant finds its way into the cooling device, possibly causing degradation of the cooling liquid, a failure of the circulation pump, etc.

On the other hand, while it is also possible to integrally arrange the circulation pump and the process unit so as to make it possible for the cooling liquid to circulate even when being pulled out, this leads to an increased size of the process unit, thus leading to reduced capabilities for maintenance and paper jamming processes. Moreover, an increased sized process unit leads to the necessity of increasing the strength of a housing which supports the same, running counter to a goal of reduced size and weight.

Furthermore, the above problem may occur not only for the process unit, but similarly also for any fixing device and other devices requiring cooling.

Patent Documents

Patent document 1: JP2006-3628A
Patent document 2: JP10-207155A

DISCLOSURE OF THE INVENTION

In light of what is described in the above, the present invention seeks to provide a cooling device which makes it possible to maintain a state of connecting between a moving cooling unit such as a cooling pipe, etc., and a cooling medium supplying unit such as the circulation pipe, and an image forming device having the cooling device.

A cooling device is provided, including a cooling section which is moveably provided with respect to an image forming device body between a first location and a second location, the second location being different from the first location, and which cools surroundings with a cooling medium to be supplied; a cooling medium supply section which is provided at the image forming device body and which cools the cooling medium to supply the cooled cooling medium to the cooling section; and a connecting member which connects the cooling section and the cooling medium supply section to circulate the cooling medium between the cooling section and the cooling medium supply section. The connecting member includes a flexible member and is supported by a guiding member which guides an operation of tracking the connecting member in conjunction with movement of the cooling section.

The cooling device is provided, in one example, in which the guiding member is an extending/contracting supporting unit which can be extended and contracted in a moving direction of the cooling section.

The cooling device is provided, in one example, in which the extending/contracting supporting unit includes multiple arm members oscillatably connected via a joint section.

The cooling device is provided, in one example, in which the joint section is provided in multiple numbers.

The cooling device is provided, in one example, in which the joint section is supported by a sliding member which slides in the moving direction.

The cooling device is provided, in one example, in which the cooling device further comprises a supporting face, the supporting face supporting a lower face of the extending/contracting supporting unit.

The cooling device is provided, in one example, in which the joint section is supported by a wire member which is mounted on the image forming device body side or the cooling section side.

The cooling device is provided, in one example, in which the joint section is supported by a moving supporting member which is moveable along a wire member mounted between the image forming device body side and the cooling section side.

The cooling device is provided, in one example, in which the cooling device further comprises a stopper which regulates an opening angle between the arm members such that the opening angle does not exceed a predetermined angle.

The cooling device is provided, in one example, in which the cooling device further comprises a biasing unit which biases in a direction such that an opening angle between the arm members closes.

The cooling device is provided, in one example, in which the guiding member is a protective member which is arranged to connect multiple unit devices such that the multiple unit devices are mutually oscillatable, and the connecting member is carried within the protective member.

The cooling device is provided, in one example, in which the cooling device further comprises a regulating member which contacts the protective member to restrict a moving range of the protective member.

The cooling device is provided, in one example, in which at least one of the protective member and the regulating member includes a sliding member.

The cooling device is provided, in one example, in which the cooling device further comprises a water-absorbing member at a face of the protective member, which face opposing the cooling section.

The cooling device is provided, in one example, in which the cooling section is arranged to be a cooling roller which contacts a recording medium onto which an image is fixed to cool the recording medium.

An image forming device is also provided that includes the cooling device as described in one of the above examples.

The present invention makes it possible to prevent a contaminant from finding its way into a flow channel since a cooling section and a cooling medium supply section may be left connected, regardless of whether the cooling section is arranged at a first location or a second location. In this way, degradation of a cooling medium and a possibility of failure of the cooling medium supply section, etc., may be prevented. Moreover, while a cooling liquid which remains in the connecting section (the separating section) of the cooling pipe drops into the image forming device when a cooling pipe is separated in the conventional cooling device, this is not the case here so that there is no possibility of causing a detrimental effect on image forming. Moreover, regardless of whether the cooling section is arranged at the first location or the second location, the cooling medium may be supplied to the cooling medium supply section, making it possible to continuously conduct cooling by the cooling section. Furthermore, the features of the present invention may be adopted to provide the cooling medium supply section in the image forming device body, making it possible to prevent an increase in size which arises as a result of integrally arranging the cooling medium supply section and the cooling section.

BRIEF DESCRIPTION OF THE DRAWINGS

Other objects, features, and advantages of the present invention will become more apparent from the following detailed descriptions when read in conjunction with the accompanying drawings, in which:

FIG. 6(*a*) is a drawing illustrating a configuration according to embodiment 1 of the present invention with a heat receiving plate being tucked in;

FIG. 6(*b*) is a diagram illustrating a configuration according to the embodiment 1 of the present invention with the heat receiving plate being pulled out;

FIG. 12(*b*) is an enlarged view of a joint section according to the embodiment 6 of the present invention;

FIG. 12(*c*) is a perspective view illustrating a stopper provided at the joint section according to the embodiment 6 of the present invention;

FIG. 13(*b*) is a perspective view of the stopper;

FIG. 14(*b*) is a perspective view of the biasing unit;

FIG. 16(*a*) is a drawing illustrating a configuration according to Embodiment 8 of the present invention with a heat receiving plate being tucked in;

FIG. 16(*b*) is a diagram illustrating a configuration according to the Embodiment 8 of the present invention with the heat receiving plate being pulled out;

FIG. 17(*a*) is a drawing illustrating a configuration of a variation of Embodiment 8 of the present invention with a heat receiving plate being tucked in;

FIG. 17(*b*) is a diagram illustrating a configuration according to the Embodiment 8 of the present invention with the heat receiving plate being pulled out;

BEST MODE FOR CARRYING OUT THE INVENTION

Descriptions are given next, with reference to the accompanying drawings, of embodiments of the present invention.

The present invention is not limited to the specifically disclosed embodiments, but variations and modifications may be made without departing from the scope of the present invention.

Embodiments according to the present invention are described, referring to FIG. 1 through FIG. 19.

Figure 1:
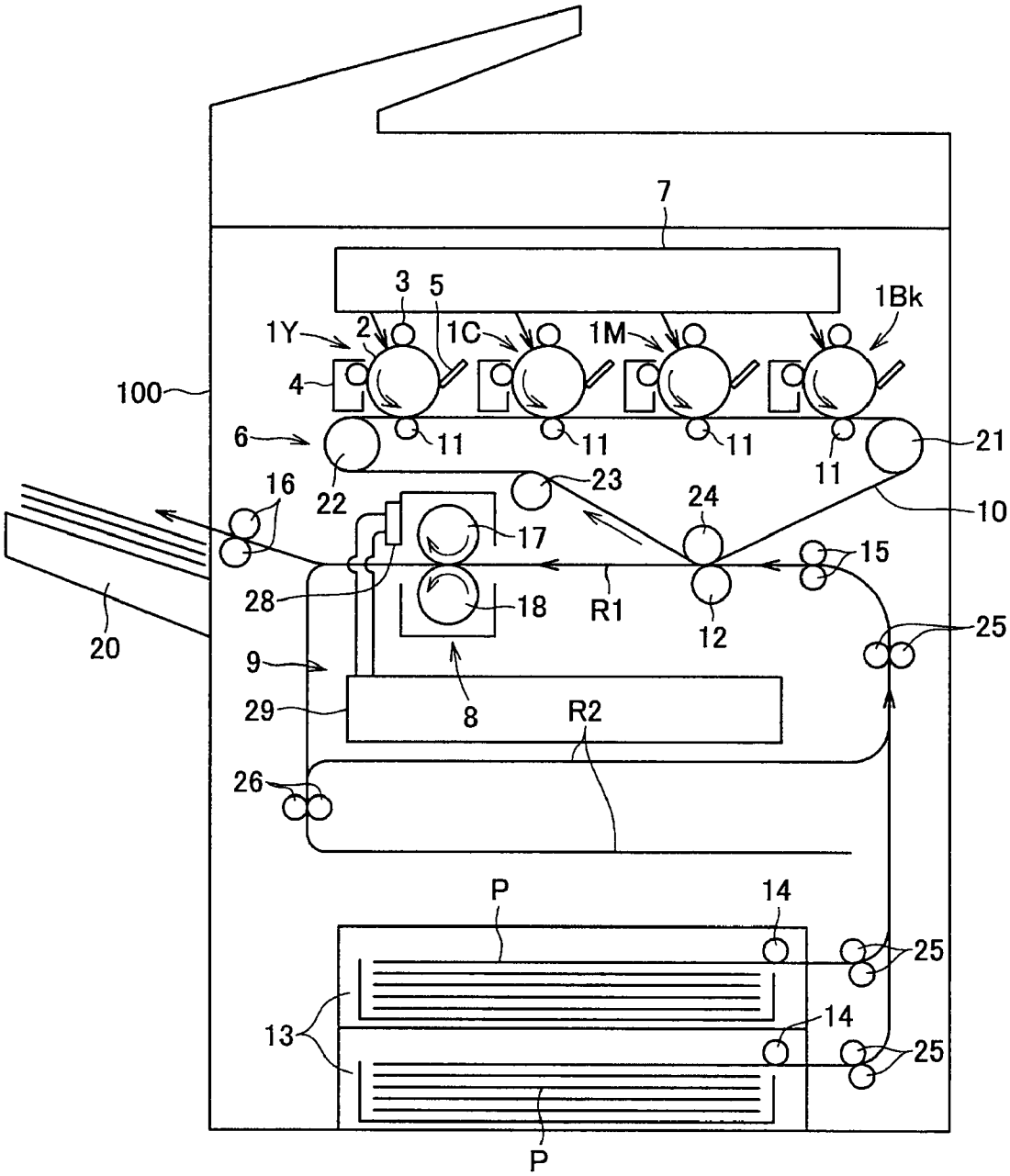
FIG. 1 is a schematic drawing illustrating an overview configuration of an image forming device according to the present invention.

FIG. 1 is an overview configuration diagram which shows an image forming device according to the present invention. The image forming device shown in FIG. 1 includes four process units, 1Y, 1C, 1M, and 1Bk. Each of the process units 1Y, 1C, 1M, and 1Bk is arranged removably with respect to the image forming device body 100. Each of the process units 1Y, 1C, 1M, and 1Bk has the same configuration except that it carries toner of different colors of yellow, cyan, magenta and black which correspond to a color separation component of a color image.

More specifically, each of the process units 1Y, 1C, 1M, and 1Bk includes a photosensitive body 2 as an electrostatic latent image bearing body, a charging roller 3 as a charging unit which charges a surface of the photosensitive body 2, a developing device 4 as a developing unit which forms a toner image on the surface of the photosensitive body 2, and a cleaning blade 5 as a cleaning unit which cleans the surface of the photosensitive body 2.

In FIG. 1, an exposing device 7 as an exposing unit is arranged above each of the process units 1Y, 1C, 1M, and 1Bk. The exposing device 7 is arranged to irradiate a laser beam on the photosensitive body 2 of each of the process units 1Y, 1C, 1M, and 1Bk. On the other hand, a transfer device 6 is arranged below each of the process units 1Y, 1C, 1M, and 1Bk. The transfer device 6 has an intermediate transfer belt 10 which includes an endless-shaped belt wound around multiple rollers 21-24. The intermediate transfer belt 10 is arranged such that one of the multiple rollers 21-24 rotates as a drive roller to drive the intermediate transfer belt 10 around in the direction shown with the arrow.

Four primary transfer rollers 11 as primary transfer units are arranged at locations opposing the four photosensitive bodies 2. Each of the primary transfer rollers 11 presses an inner peripheral face of the intermediate transfer belt 10 at its respective location with a primary transfer nip being formed where each of the photosensitive bodies 2 is in contact with a portion where the intermediate transfer belt 10 is being pressed. Moreover, a secondary transfer roller 12 as a secondary transfer unit is arranged at a location opposing one roller 24 which stretches the intermediate transfer belt 10. The secondary transfer roller presses an outer peripheral face of the intermediate transfer belt 10 with the secondary transfer nip being formed where the secondary transfer roller 12 and the intermediate transfer belt 10 are in contact.

Multiple paper supplying cassettes 13 which carry a recording sheet P as a recording medium are arranged at a lower portion of the image forming device body 100. Each of the paper supplying cassettes 13 is provided with a paper supplying roller 14 which sends out the recording sheet P. Moreover, a paper-output tray 20 which stocks the recording sheet P discharged to outside the machine is provided on an outer face on the left side of the drawing of the image forming device body 100.

A conveying route R1 for conveying the recording sheet P from the paper supplying cassette 13 via the secondary transfer nip to the paper-output tray 20 is arranged within the image forming device body 100. A regist roller 15 is arranged upstream in the recording sheet conveying direction of the secondary transfer nip between the intermediate transfer belt 10 and the secondary transfer roller 12. Moreover, multiple conveying rollers 25 are arranged on the way from the paper supplying cassette 13 to the secondary transfer nip. A fixing device 8 and a pair of paper-output rollers 16 are successively arranged downstream in the recording sheet conveying direction of the secondary transfer nip. The fixing device 8 includes, for instance, a heating roller 17 which has a heating source inside and a pressurizing roller 18 which pressurizes the heating roller 17. The heating roller 17 and the pressurizing roller 18, which are mutually pressure-joined, form a fixing nip at the pressure-joined section.

Moreover, a turnover route R2 is provided within the image forming device body 100 for supplying the recording sheet P with the front and the back being turned over when conducting double-face printing. The turnover route R2 branches out from the conveying route R1 between the fixing device 8 and the paper-output roller 16, merging with the conveying route R1 upstream of the regist roller 15. The turnover route R2 is provided with a switchback roller 26 which rotates in right and inverse directions.

Below, a basic operation of the image forming device is described with reference to FIG. 1.

A photosensitive body 2 of each of the process units 1Y, 1C, 1M, and 1Bk is rotationally driven in the counterclockwise direction shown, and the surface of each of the photosensitive bodies 2 is uniformly charged to a predetermined polarity with the charging roller 3. Based on image information of a document read with a reading device not shown, a laser beam is irradiated from the exposing device 7 on the surface of each of the photosensitive bodies 2 that is charged to form an electrostatic latent image on the surface of each of the photosensitive bodies 2. Here, the image information exposed to each of the photosensitive bodies 2 is information on a monochrome image, which is a desired full-color image resolved into color information of yellow, cyan, magenta, and black. In this way, toner is supplied by each of the developing devices to the electrostatic latent image formed on the photosensitive body 2, so that the electrostatic latent image is made a visible image as a toner image.

One of rollers which stretch the intermediate transfer belt 10 is rotationally driven, causing the intermediate transfer belt 10 to revolve in the direction of the arrow shown. Moreover, a constant voltage or constant-current-regulated voltage having a polarity opposite to the toner charge polarity is applied to each of the primary transfer rollers 11, so that a transfer electric field is formed at the primary transfer nip between each of the primary transfer roller 11 and each of the photosensitive bodies 2. Then, a toner image of each color that is formed on each of the photosensitive bodies 2 is transferred in a successively overlapping manner on the intermediate transfer belt 10 with the transfer electric field formed at the primary transfer nip. Thus, the intermediate transfer belt 10 bears a full-color toner image on the surface. Moreover, toner which fails to be transferred to the intermediate transfer belt 10 remains on the surface of each of the photosensitive bodies 2 after the transfer. The toner which remains on the photosensitive body 2 is removed with the cleaning blade 5.

Moreover, the paper-supplying roller 14 rotates to send out the recording sheet P from the paper-supplying cassette 13. The sent out recording sheet P, after being conveyed with the multiple conveying rollers 25, is sent to the secondary transfer nip between the secondary transfer roller 12 and the intermediate transfer belt 10 with the timing being measured with the regist roller 15. Then, a transfer voltage having a polarity opposite the toner charging polarity of the toner image on the intermediate transfer belt 10 is applied to the secondary transfer roller 12, a transfer electric field being formed thereat. Then, with the transfer electric field formed at the secondary transfer nip, the toner image on the intermediate transfer belt 10 is collectively transferred onto the recording sheet.

The recording sheet P onto which the toner image is transferred is conveyed to the fixing device 8. The recording sheet P sent into the fixing device 8 is nipped between the heating roller 17 and the pressurizing roller 18 to be heated and pressurized, the toner image being fixed onto the recording sheet P. Thereafter, the recording sheet P is discharged to the paper-output tray 20 with the pair of discharge rollers 16.

While the above describes an image forming operation when a full-color image is formed on a recording sheet, it is also possible to use one of the four process units 1Y, 1C, 1M, and 1Bk to form a mono-chromatic image or to use two or three of the process units to form an image of two or three colors.

Moreover, for conducting a double-face printing, a recording sheet P having an image fixed on one face (a front face) is conveyed to the turnover route R2 without discharging to the paper-output tray 20. At the turnover route R2, the paper sheet P is conveyed in the reverse direction with a reverse rotation by the switchback roller 26, and sent again to the conveying route R1. The above-described operation, which is generally called a switchback operation, turns over the front and the back of the recording sheet P.

The turned over recording sheet P is conveyed to the secondary transfer nip, where an image is transferred to the back face of the recording sheet P in the same manner as a case in which an image is transferred to one face. Then, after the image is fixed to the back face of the recording sheet P with the fixing device 8, the recording sheet P is discharged to the paper-output tray 20.

Here, from a point of view of reducing the device size, the image forming device as shown in FIG. 1 is arranged such that the density within the device is increased and the fixed device 8 slips below the intermediate transfer belt 10. Moreover, the intermediate transfer belt 10 bends such that it covers the upper face and the right-side face of the fixing device 8. However, adopting such a configuration may cause the fixing device 8 to approach the intermediate transfer belt 10, the intermediate transfer belt 10 to receive a thermal effect due to the fixing device 8 as a heat liberating source, and image failures such as color drift, etc. to occur. This is becoming prominent as the amount of heat liberated within the device increases with an increase in speed of the device. In particular, when conducting the double-face printing, the recording sheet P heated up with the fixing device 8 again contacts the intermediate transfer belt 10. Thus, heat conduction from the recording sheet P increases the temperature of the intermediate transfer belt 10 further, leading to a more severe condition. Moreover, heat is conducted to the photosensitive body 2, which is in contact with the intermediate transfer belt 10, as well as the developing device 4, leading to an increased possibility of occurrence of image failure due to belt deforming and a failure such as solidifying of the toner, etc.

Then, in order to suppress the occurrence of the failures as described above, the image forming device according to the invention includes a cooling device 9 which cools the fixing device. The cooling device 9 includes a cooling section 28 arranged in a neighborhood of the fixing device 8 and a cooling medium supplying section 29 which supplies, to the cooling section 28, the cooling medium by cooling or radiation.

Figure 2:
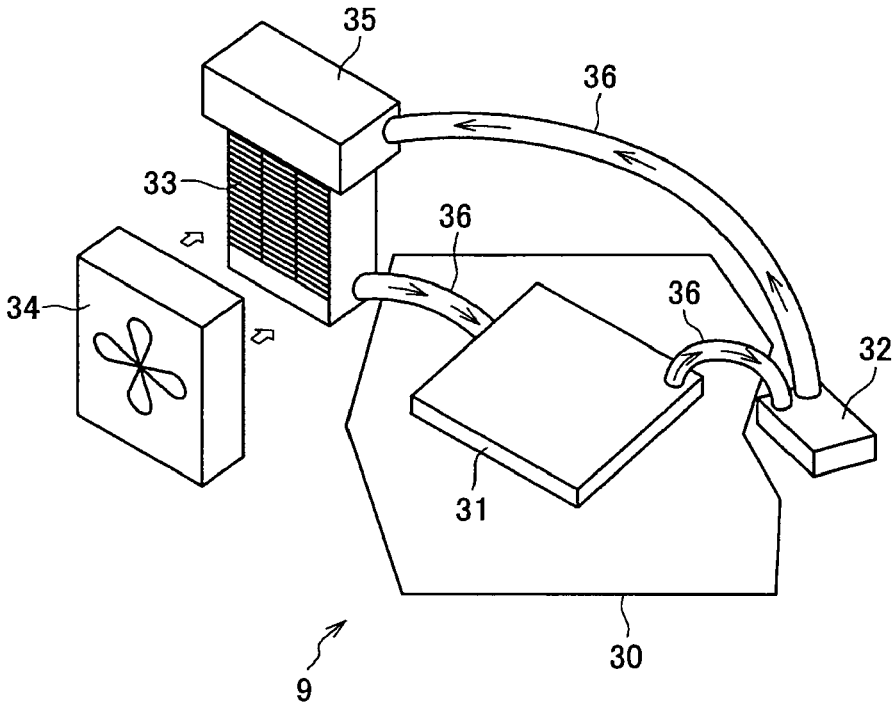
FIG. 2 is a diagram illustrating a basic configuration of a cooling device.

FIG. 2 is a diagram illustrating a basic configuration of the cooling device 9.

As shown in FIG. 2, the cooling device 9 has a heat receiving plate 31 as the cooling section 28 which cools a body to be cooled 30, a pump 32 as the cooling medium supplying section 29, a radiator 33, a fan 34, a tank 35 which stores the cooling medium and a circulation route 36 for circulating the cooling medium. Moreover, with the circulation route 36, the heat receiving plate 31, the pump 32, the radiator 33, and the tank 35 are connected.

The heat receiving plate 31, which is formed using a member of high heat conductivity, has a flow channel in which the cooling medium flows is formed by pasting or embedding. Moreover, the heat receiving plate 31 may be arranged such that it forms a flow channel itself. The heat receiving plate 31 is arranged such that heat taken away from the body to be cooled 30 is passed on to the cooling medium.

The pump 32 is a cooling medium supplying unit which supplies a cooling medium to the heat receiving plate 31 via the circulation route 36. Here, as the cooling medium, a cooling liquid is used which has water as the main ingredient, and which has added propylene glycol or ethylene glycol for decreasing the freezing temperature, or an anti-corrosive agent (e.g., phosphate salt materials: phosphate potash, inorganic potash, etc.) for preventing a metal part from rusting. Moreover, it is arranged for the cooling liquid to circulate within the circulation route 36 in the direction of the arrow in FIG. 2.

The radiator 33 is a radiating unit which radiates the cooling liquid by carrying therein the cooling liquid. The fan 34 directs air into the radiator 33 to enhance the effect of radiation of the radiator 33. Moreover, according to the amount of radiation of the radiator 33, switching between natural air cooling and forced air cooling with the fan 34 is made possible. The tank 35 is provided for storing excess cooling liquid.

Figure 3:
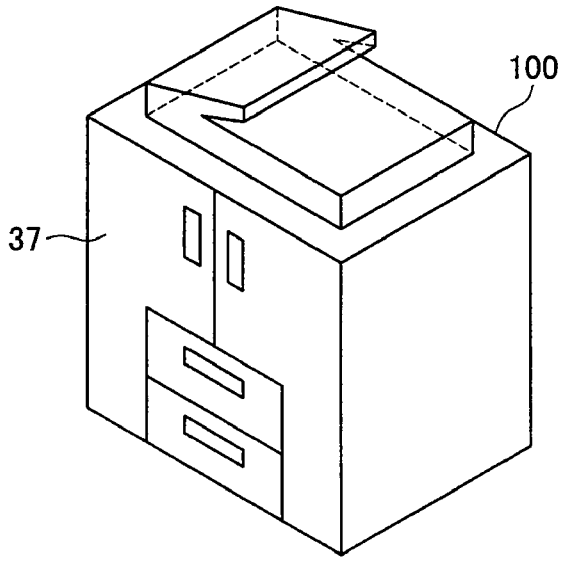
FIG. 3 is an external view of the image forming device with doors closed.
Figure 4:
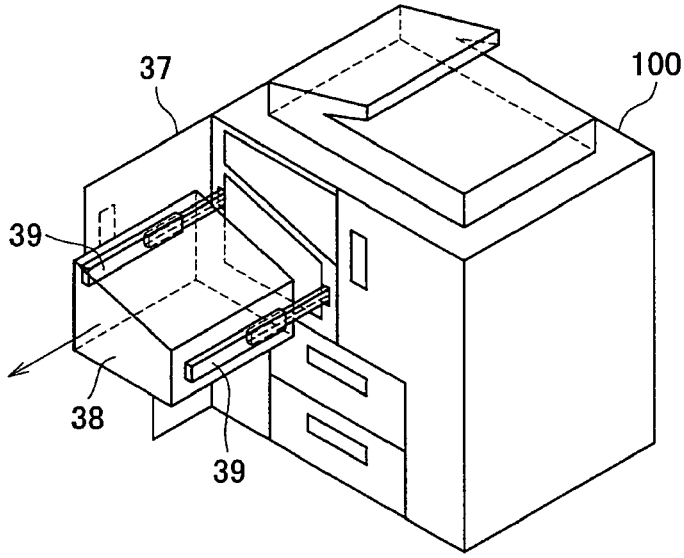
FIG. 4 is an external view of the image forming device with a door open.

FIGS. 3 and 4 are external views of the image forming device according to the present invention.

As illustrated in FIG. 3, doors 37 which can be opened/closed is provided on an external face of the image forming device 100. FIG. 4 illustrates the door 37 being opened. It is arranged such that opening the door 37 makes it possible to pull out, from where it is open, a pull out section (pull out unit) 38 being tucked in. In the present embodiment, the pull out section 38, which is supported by a pair of sliding members 39 provided at the image forming device body 100, is made possible to be pulled out and tacked in by the sliding member 39 sliding to extend and contract. However, any other pulling out mechanisms can also be selected to apply the same.

Figure 5:
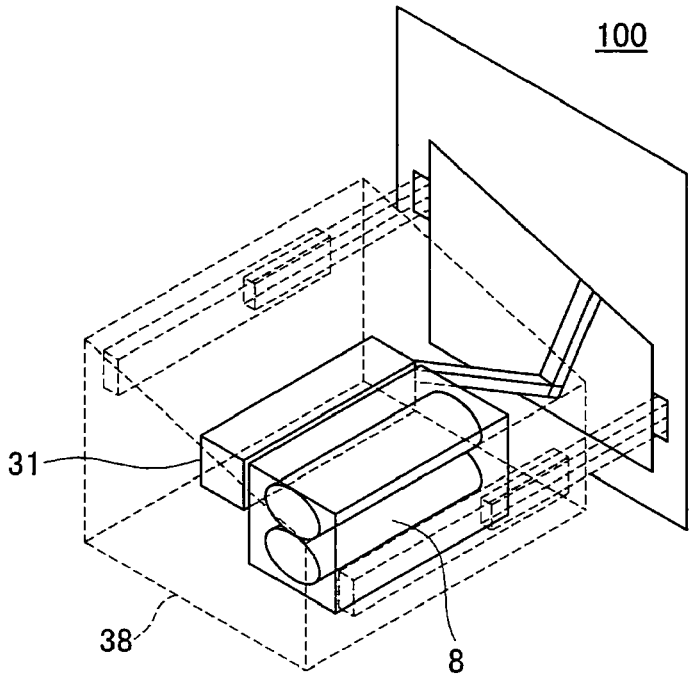
FIG. 5 is a drawing illustrating the image foaming device with a pulling out section being pulled out.

As shown in FIG. 5, the fixing device 8 is provided with the pulling out section 38. In this way, the fixing device 8 is arranged to be able to be pulled out to outside the image forming device body 100 to facilitate performing maintenance and paper jamming processes. Moreover, the heat receiving plate 31 is also arranged to be able to be pulled out integrally with the fixing device 8. On the other hand, the pump 32, the radiator 33, the fan 34, and the tank 35 which are not shown herein are fixed to the image forming device body 100. In this way, in the present embodiment, the heat receiving plate 31 is arranged to be moveable with respect to the pump 32 fixed. However, unlike the conventional image forming device, it is arranged such that pulling out the heat receiving plate 31 does not separate the connection between the heat receiving plate 31 and the pump 32, etc. Below, the features of the characterizing portion of the present invention are described in detail.

Embodiment 1

Figure 6A:
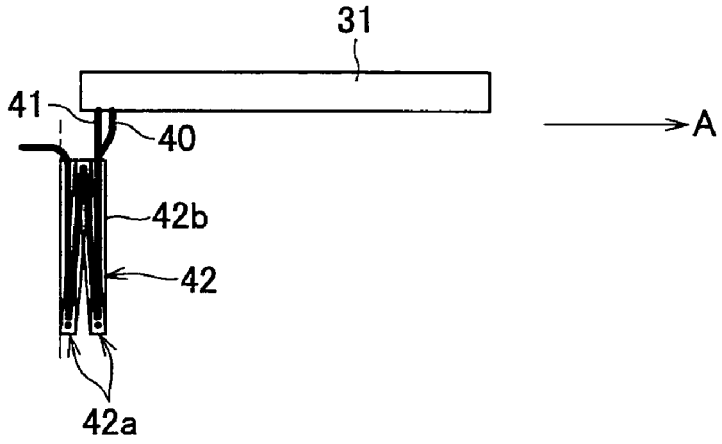
Figure 6B:
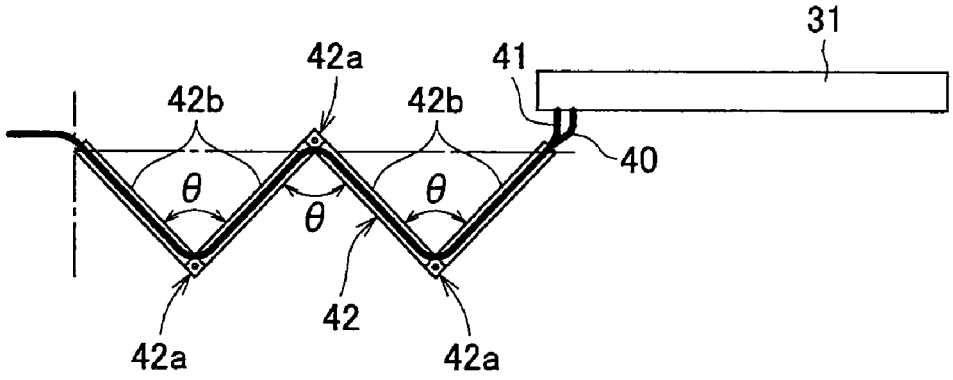

FIGS. 6(*a*) and 6(*b*) are diagrams illustrating a configuration according to Embodiment 1 of the present invention. FIG. 6(*a*) is a lateral view of the heat receiving plate 31 being tucked in and FIG. 6(*b*) is a lateral view of the heat receiving plate 31 being pulled out. Moreover, in FIGS. 6(*a*) and 6(*b*), the fixing device 8, etc. are omitted.

As illustrated in FIGS. 6(*a*) and 6(*b*), a supply tube 40 for supplying the cooling liquid into the heat receiving plate 31 and a discharge tube 41 for discharging the cooling liquid from the heat receiving plate 31 are connected to the heat receiving plate 31. The supply tube 40 and the discharge tube 41 are flow channels which make up a part of the circulation routes 36 as shown in FIG. 2. More specifically, a connecting member which connects the heat receiving plate 31 and the radiator 33 is the supply tube 40, while a connecting member which connects the heat receiving plate 31 and the pump 32 is the discharge tube 41. The supply tube 40 and the discharge tube 41, which are respectively tube-shaped members, are made of a flexible member such as rubber.

The supply tube 40 and the discharge tube 41 are supported by an extending/contracting supporting unit 42 which can be extended/contracted in the moving direction A of the heat receiving plate 31. More specifically, the extending/contracting supporting unit 42 includes multiple arm members 42*b* oscillatably connected via a joint section 42*a*. An opening angle θ between the arm members 42*b* can be changed to extend and contract the extending and contracting supporting unit 42 as a whole. In the present embodiment, the arm members 42*b* are arranged such that they bend in a zigzag manner in the upward and downward directions. Moreover, one joint section 42*a* may be provided, but providing multiple joint sections 42*a* makes it possible to shorten the arm member 42*b* and compactly tuck in the arm members 42*b*.

The arm member 42*b* includes a tubular member formed by sheet metal, etc. Then, the supply tube 40 and the discharge tube 41 are carried within the arm member 42. Moreover, the supply tube 40 and the discharge tube 41 may be mounted along the external face of the arm member 42*b*. When the supply tube 40 and the discharge tube 41 are carried within the arm member 42*b*, the supply tube 40 and the discharge tube 41 may be prevented from getting impaired and may be reduced in size. The supply tube 40 and the discharge tube 41 are set to a length sufficient to be able to connect between the heat receiving plate 31 and the pump 32 and between the heat receiving plate 31 and the radiator 33 when the receiving plate 31 shown in FIG. 6(*b*) is pulled out completely.

As shown in FIG. 6(*b*), when the heat receiving plate 31 is pulled out, the connecting section with the heat receiving plate 31 of the discharge tube 41 and the supply tube 40 moves (moves forward) in a manner such that it tracks the heat receiving plate 31. Moreover, in conjunction with the tracking operation, the opening angle θ between the arm members 42*b* gets bigger and the extending/contracting supporting unit 42 extends. In this way, even when the heat receiving plate 31 is pulled out, the heat receiving plate 31 and the pump 32 may be left connected and cooling liquid may be supplied to the heat receiving plate 31.

Moreover, as shown in FIG. 6(*a*), when the heat receiving plate 31 is tucked in, as the connecting section with the heat receiving plate 31 of the supply tube 40 and the discharge tube 41 moves (moves backward), tracking the heat receiving plate 31, the opening angle θ between the arm member 42*b* becomes small and the extending/contracting unit 42 contracts. As a result, the arm member 42*b* is folded such that the supply tube 40 and the discharge tube 41 are tucked in compactly.

Embodiment 2

Figure 7:
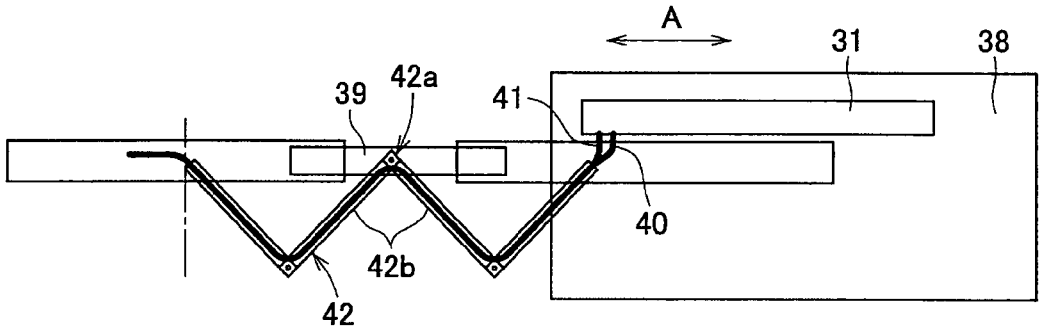
FIG. 7 is a diagram illustrating a configuration according to embodiment 2 of the present invention.

FIG. 7 is a diagram illustrating a configuration according to Embodiment 2 of the present invention with a lateral view of the heat receiving plate 31 being pulled out.

As shown in FIG. 7, in Embodiment 2, in a manner similar to Embodiment 1, an extending/contracting supporting unit 42 is provided which includes multiple arm members 42*b* oscillatably connected via the joint section 42*a*, the supply tube 40 and the discharge tube 41 being tucked in the arm members 42*b*. Moreover, in Embodiment 2, a joint section 42*a* of the extending/contracting supporting unit 42 is mounted to the sliding member 39 which supports the pulling out section 38 in such a manner that the pulling out section 38 can be pulled out and tucked in. More specifically, a joint section 42*a* which is arranged on the upper side out of multiple joint sections 42*a* alternately arranged in the upward and downward directions is mounted to the sliding member 39. In this way, the extending/contracting supporting unit 42 is supported by the sliding member 39. Here, while the sliding member 39 which supports the pulling out section 38 is used in common with a member which supports the extending/contracting supporting unit 42, a sliding member may be provided separately for supporting the extending/contracting unit 42.

In Embodiment 2, when the heat receiving plate 31 is pulled out, as in Embodiment 1, the supply tube 40 and the discharge tube 41 track the heat receiving unit 31 and the extending/contracting supporting unit 42 extends, so that the heat receiving plate 31 and the pump 32, etc., may be left connected even when the heat receiving plate 31 is being pulled out. Moreover, even when the heat receiving plate 31 is tucked in, as in the Embodiment 1, the supply tube 40 and the discharge tube 41 track the heat receiving plate 31 and the extending/contracting supporting unit 42 contract, making it possible to compactly tuck in the supply tube 40 and the discharge tube 41.

Moreover, in Embodiment 2, the joint section 42*a* of the extending/contracting unit 42 is supported by the sliding member 39 which slides in the moving direction A of the heat receiving plate 31, making it possible to prevent a failure such as slanting of the arm member 42*b* when the extending/shrinking supporting unit 42 extends, making it possible to stably perform extending/contracting operations.

Embodiment 3

Figure 8:
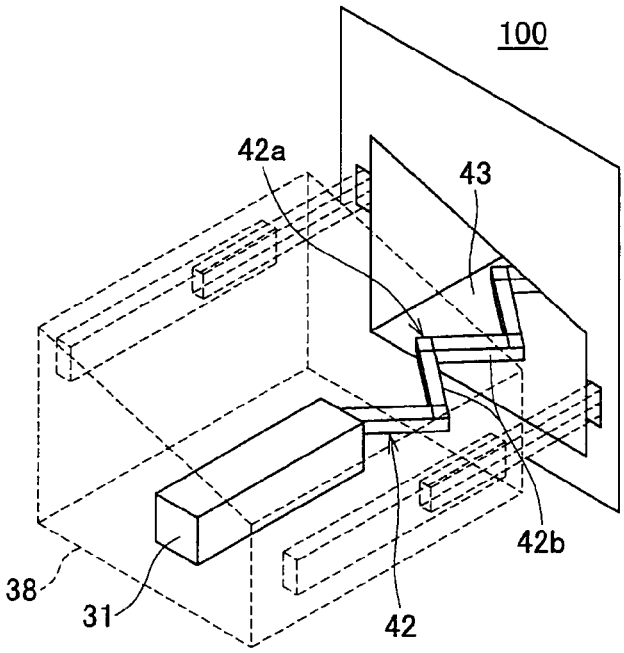
FIG. 8 is a diagram illustrating a configuration according to embodiment 3 of the present invention.
Figure 9:
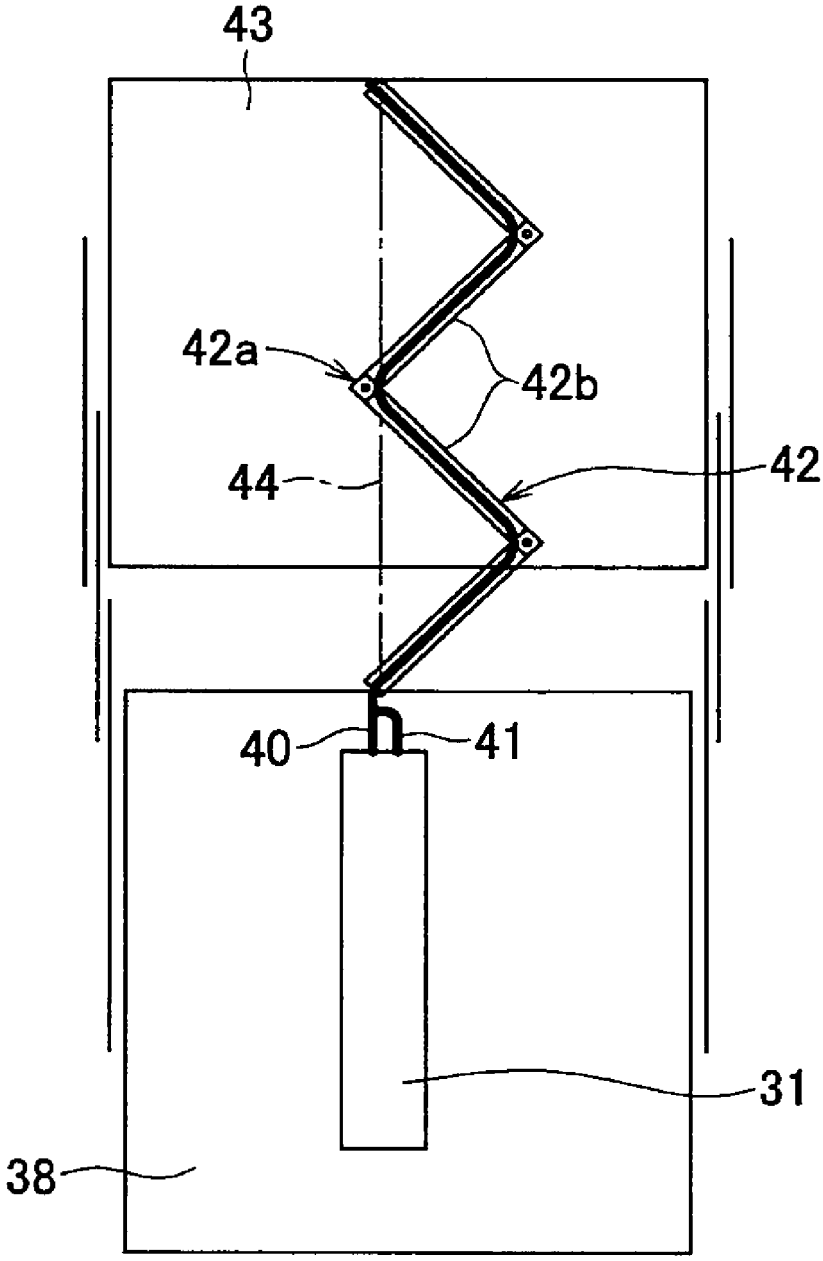
FIG. 9 is FIG. 8 viewed from the top.

FIGS. 8 and 9 are diagrams illustrating configurations according to Embodiment 3 of the present invention. FIG. 8 is a lateral view of the heat receiving plate 31 being pulled out, while FIG. 9 is a top view of the heat receiving plate 31 being pulled out. In FIGS. 8 and 9, the fixing device 8, which is provided at the pulling out section 38, is omitted.

As shown in FIG. 8 or FIG. 9, in Embodiment 3, as in Embodiment 1, there is provided an extending/contracting supporting unit 42 which includes multiple arm members 42*b*, which are oscillatably connected via the joint section 42*a*. Moreover, as shown in FIG. 9, the supply tube 40 and the discharge tube 41 are carried within the arm member 42*b*. In Embodiment 3, unlike the previously-described Embodiments, the arm members 42*b* are arranged such that they bend laterally in a zigzag manner. Moreover, the arm member 42*b* is arranged such that it contacts a bottom plate 43 which is arranged at the image forming device body 100. In other words, the bottom plate 43 serves as a supporting face which supports the bottom face of the extending/contracting supporting unit 42 (arm member 42*b*).

In Embodiment 3, as in each of the above-described Embodiments, when the heat receiving plate 31 is pulled out, the supply tube 40 and the discharge tube 41 track the heat receiving unit 31 and the extending/contracting supporting unit 42 extends, so that the heat receiving plate 31 and the pump 32, etc., may be left connected even when the heat receiving plate 31 is being pulled out. Moreover, even when the heat receiving plate 31 is being tucked in, as in each of the above-described Embodiments, the supply tube 40 and the discharge tube 41 track the heat receiving plate 31 and the extending/contracting supporting unit 42 contracts, making it possible to compactly carry the supply tube 40 and the discharge tube 41.

Moreover, in the Embodiment 3, when the extending/contracting supporting unit 42 extends/contracts, the arm member 42*b* is being supported by the bottom plate 43, making it possible to prevent a failure such as slanting of the arm member 42*b*, making it possible to stably perform the extending/contracting operations.

Moreover, as shown in FIG. 9, a guiding wire may be installed across the image forming device body side and the pulling out section 38 side. Guiding the joint section 42*a* with the guiding wire allows the position of the joint section 42*a* in the extending/contracting operations to be accurately determined, making it possible to more stably perform the extending/contracting operations of the extending/contracting supporting unit 42.

Embodiment 4

Figure 10:
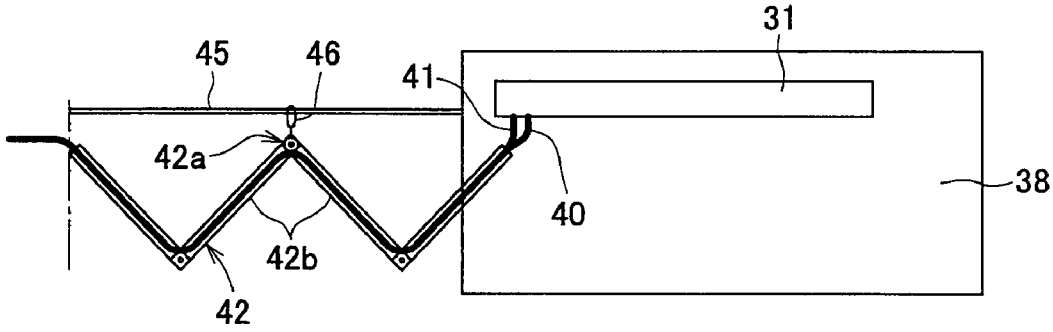
FIG. 10 is a diagram illustrating a configuration according to embodiment 4 of the present invention.

FIG. 10 is a diagram illustrating a configuration according to Embodiment 4 of the present invention with a lateral view of the heat receiving plate 31 being pulled out from the image forming device.

As shown in FIG. 10, in Embodiment 4, as in each of the above-described Embodiments, an extending/contracting supporting unit 42 is provided which includes multiple arm members 42*b* oscillatably connected via the joint section 42*a*, the supply tube 40 and the discharge tube 41 being carried in the arm members 42*b*. Moreover, in Embodiment 4, a wire member 45 is arranged across the image forming device body side and the pulling out section 38 side, and the joint section 42*a* of the extending/contracting unit 42 is supported by a moving support member 46 which is moveable along the wire member 45. More specifically, a joint section 42*a* which is arranged on the upper side out of multiple joint sections 42*a* alternately arranged in the upward and downward directions is supported by the moving support member 46. In this case, the moving support member 46 includes a ring-shaped member, which is arranged to be moveable along the wire member 45 by inserting the wire member 45 into the ring-shaped member.

In Embodiment 4, as in each of the above-described Embodiments, when the heat receiving plate 31 is being pulled out, the supply tube 40 and the discharge tube 41 track the heat receiving plate 31 and the extending/contracting supporting unit 42 extends, so that the heat receiving plate 31 and the pump 32, etc., may be left connected even when the heat receiving plate 31 is being pulled out. Moreover, even when the heat receiving plate 31 is being tucked in, as in each of the above-described Embodiments, the supply tube 40 and the discharge tube 41 track the heat receiving plate 31 and the extending/contracting supporting unit 42 contract, making it possible to compactly carry the supply tube 40 and the discharge tube 41.

Moreover, in Embodiment 4, when the extending/contracting supporting unit 42 extends/contracts, the joint section 42*a* of the extending/contracting supporting unit 42 is supported by the moving support member 46 which moves along the wire member 45, making it possible to prevent a failure such as slanting of the arm member 42*a* when the extending/contracting supporting unit 42 extends/contracts, making it possible to stably perform extending/contracting operations.

Embodiment 5

Figure 11:
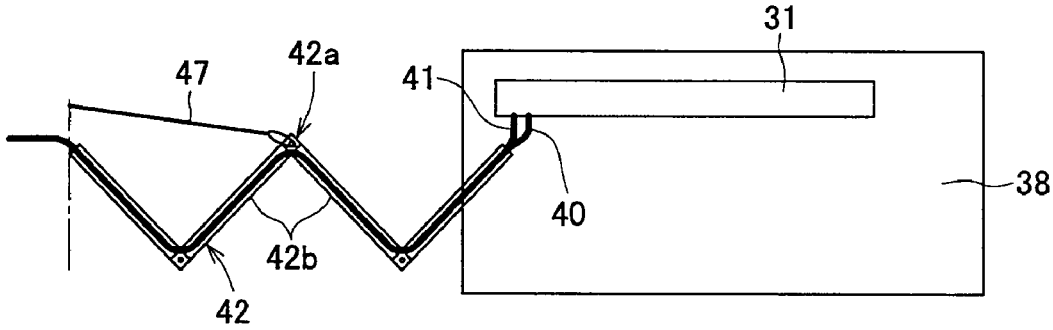
FIG. 11 is a diagram illustrating a configuration according to embodiment 5 of the present invention.

FIG. 11 is a diagram illustrating a configuration according to Embodiment 5 of the present invention with a lateral view of the heat receiving plate 31 being pulled out from the image forming device.

As shown in FIG. 11, in Embodiment 5, as in each of the above-described Embodiments, an extending/contracting supporting unit 42 is provided which includes multiple arm members 42*b* oscillatably connected via the joint section 42*a*, the supply tube 40 and the discharge tube 41 being carried in the arm members 42*b*. Moreover, the joint section 42*a* of the extending/contracting supporting unit 42 is supported by the wire member 47. More specifically, the joint section 42*a* arranged on the upper side is held by the wire member 47. In this case, one end of the wire member 47 is installed on the image forming device body side, but the one end may be installed on the pulling out section 38 side.

In Embodiment 5, as in each of the above-described Embodiments, when the heat receiving plate 31 is being pulled out, the supply tube 40 and the discharge tube 41 track the heat receiving plate 31 and the extending/contracting supporting unit 42 extends/contracts, so that the heat receiving plate 31 and the pump 32, etc., may be left connected even when the heat receiving plate 31 is being pulled out. Moreover, even when the heat receiving plate 31 is being tucked in, as in each of the above-described Embodiments, the supply tube 40 and the discharge tube 41 track the heat receiving plate 31 and the extending/contracting supporting unit 42 contracts, making it possible to compactly carry the supply tube 40 and the discharge tube 41.

Moreover, in Embodiment 5, when the extending/contracting supporting unit 42 extends/contracts, the joint section 42*a* of the extending/contracting supporting unit 42 is supported by the wire member 47, making it possible to prevent a failure such as slanting of the arm member 42*b* when the extending/contracting supporting unit 42 extends/contracts, making it possible to stably perform extending/contracting operations. Moreover, in this case, merely supporting the joint section 42*a* by the wire member 47 makes it possible to achieve prevention of slanting of the arm member 42*b*, etc., in an easy and low-cost manner.

Embodiment 6

Figure 12A:
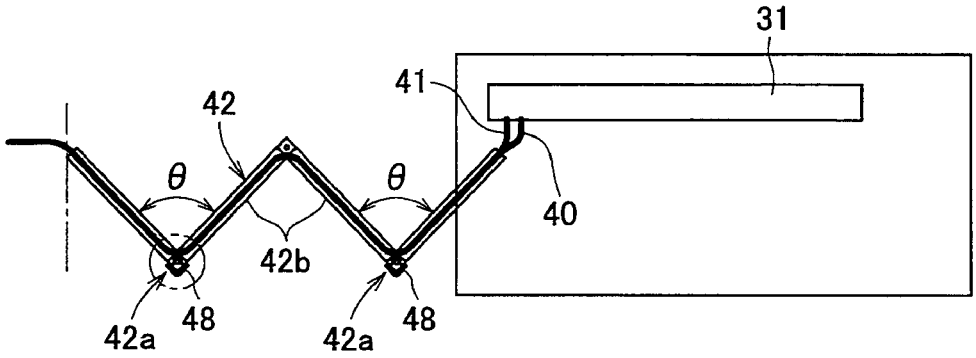
FIG. 12(*a*) is a diagram according to embodiment 6 of the present invention with a heat receiving plate being pulled out.
Figure 12B:
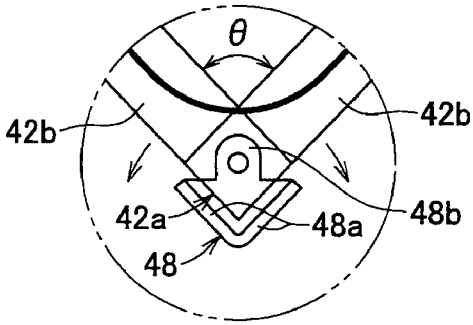
Figure 12C:
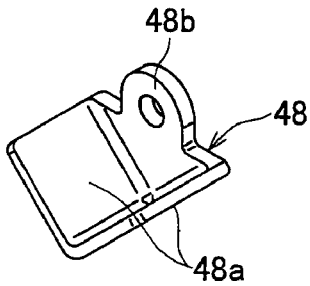

FIGS. 12(*a*), 12(*b*), and 12(*c*) are diagrams illustrating a configuration according to Embodiment 6 of the present invention. FIG. 12(*a*) is a lateral view of the heat receiving plate 31 being pulled out, FIG. 12(*b*) is an enlarged view of the joint section 42*a*, and FIG. 12(*c*) is a perspective view of a stopper provided at the joint section 42*a*.

As shown in FIG. 12(*a*), in Embodiment 6, as in each of the above-described Embodiments, an extending/contracting supporting unit 42 is provided which includes multiple arm members 42*b* oscillatably connected via the joint section 42*a*, the supply tube 40 and the discharge tube 41 being carried in the arm members 42*b*. Moreover, in Embodiment 6, a stopper 48 is provided at the joint section 42*a* of the extending/contracting supporting unit 42, which stopper regulates the opening angle θ between the arm members 42*b* such that it does not exceed a predetermined angle. In this Embodiment, the stopper 48 is provided at a joint section 42*a* which is arranged on the lower side out of multiple joint sections 42*a* alternately arranged in the upward and downward directions.

As shown in FIG. 12(*b*) or FIG. 12(*c*), the stopper 48 has a regulating section 48*a* which is formed in a V-letter shape. If the arm members 42*b* were to oscillate beyond a predetermined opening angle, each of the arm members 42*b* interferes with the regulating section 48*a* to regulate the opening angle θ such that it does not exceed a predetermined angle. Moreover, the stopper 48 has a mounting section 48*b* at which a hole is formed. By inserting a mounting member such as a screw into a hole of the mounting section 48, it is arranged for the stopper 48 to be mounted onto the joint section 42*a*.

In Embodiment 6, as in each of the above-described Embodiments, when the heat receiving plate 31 is being pulled out, the supply tube 40 and the discharge tube 41 track the heat receiving plate 31 and the extending/contracting supporting unit 42 extends, so that the heat receiving plate 31 and the pump 32, etc., may be left connected even when the heat receiving plate 31 is being pulled out. Moreover, even when the heat receiving plate 31 is being tucked in, as in each of the above-described Embodiments, the supply tube 40 and the discharge tube 41 track the heat receiving plate 31 and the extending/contracting supporting unit 42 contracts, making it possible to compactly carry the supply tube 40 and the discharge tube 41.

Moreover, in Embodiment 6, when the extending/contracting supporting unit 42 is extended, excessive opening of the opening angle θ between the arm members 42*b* may be prevented by the stopper 48, making it possible to stably perform extending and contracting operations. Moreover, in this case, merely providing a stopper 48 at the joint section 42*a* provides for achieving stability of the extending/contracting operations of the arm member 42*b* in an easy and low-cost manner.

Figure 13A:
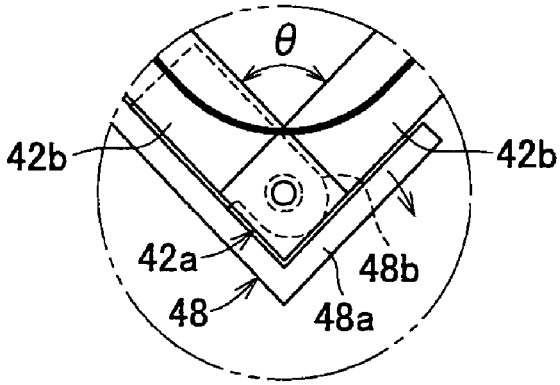
FIG. 13(*a*) is a drawing illustrating a different stopper with an enlarged view of a joint section.
Figure 13B:
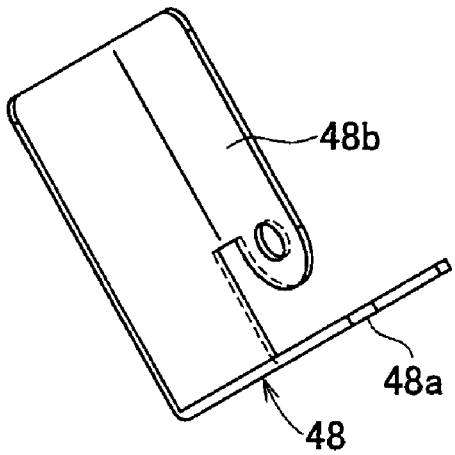

Moreover, FIGS. 13(*a*) and 13(*b*) show a variation of the stopper 48. FIG. 13(*a*) is an enlarged view of the joint section 42*a*, while FIG. 13(*b*) is a perspective view of the stopper 48 provided at the joint section 42*a*.

While, in the embodiment shown in FIGS. 12(*a*), 12(*b*), and 12(*c*), both of the arm members 42*b* are oscillatable with respect to the stopper 48 as long as the opening angle does not exceed a predetermined angle, the stopper 48 is fixed to one of the arm members 42*b* in the embodiment shown in FIGS. 13(*a*) and 13(*b*). In FIG. 13(*a*), the stopper 48 is mounted, in a fixed manner, to the arm member 42*b* on the left side via the mounting section 48*b*. In this case, the right portion of the diagram out of the V-letter shaped portions becomes a regulating unit 48*a*. Therefore, if the aim members 42*b* were to oscillate beyond a predetermined opening angle θ, the oscillation of the arm member 42*b* on the right side shown is regulated by the regulating section 48*a*. This makes it possible to prevent an excessive opening between the arm members 42*b* as in the above-described embodiment in FIG. 12(*a*), 12(*b*), or 12(*c*), making it possible to stably perform extending/contracting operations.

Embodiment 7

Figure 14A:
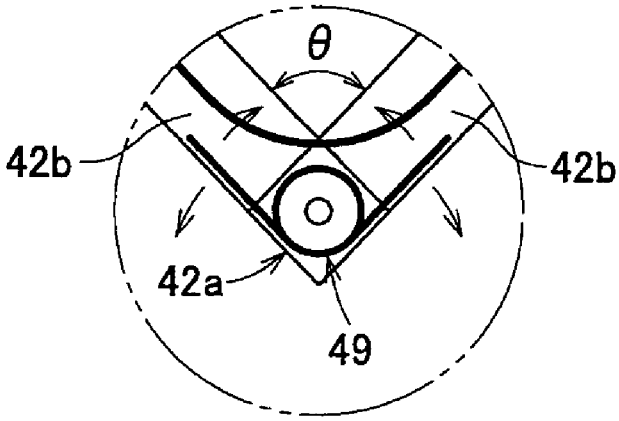
FIG. 14(*a*) is a drawing illustrating a biasing unit with an enlarged view of a joint section.
Figure 14B:
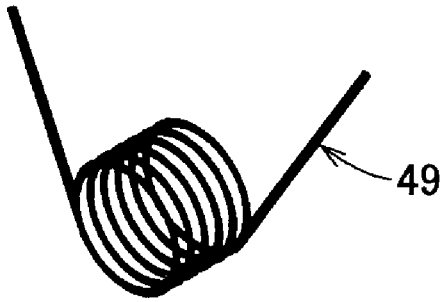

FIGS. 14(*a*) and 14(*b*) are diagrams illustrating a configuration according to Embodiment 7 of the present invention. FIG. 14(*a*) is an enlarged view of the joint section 42*a*, while FIG. 14(*b*) is a perspective view of a biasing unit 49 provided at the joint section 42*a*.

In Embodiment 7, the biasing unit 49 in lieu of the stopper 48 is provided at the joint section 42*a*. In this embodiment, the biasing unit 49 includes torsion coil springs, etc., but other biasing units may be used. The biasing unit 49 is biased in the direction such that the opening angle θ between the arm members 42*b* becomes smaller. As the opening angle θ between the arm members 42*b* becomes large, the biasing force by the biasing unit 49 becomes large, making it possible to prevent the opening angle θ from becoming excessively large, making it possible to stably perform extending/contracting operations. Moreover, merely providing a biasing unit 49 at the joint section 42*a* provides for achieving stability of the extending/contracting operations of the arm member 42*b* in an easy and low-cost manner.

In Embodiment 7, the other features are similar to the above-described Embodiment 6, so that explanations are omitted.

In the embodiments of the present invention, a cooling device which cools a fixing device has been explained, but the features of the present invention are also applicable to a cooling device which cools a body to be cooled, the body being something other than the fixing device. For example, FIG. 15 shows an example in which the features of the present invention are applied to a cooling device which cools a recording sheet.

Figure 15:
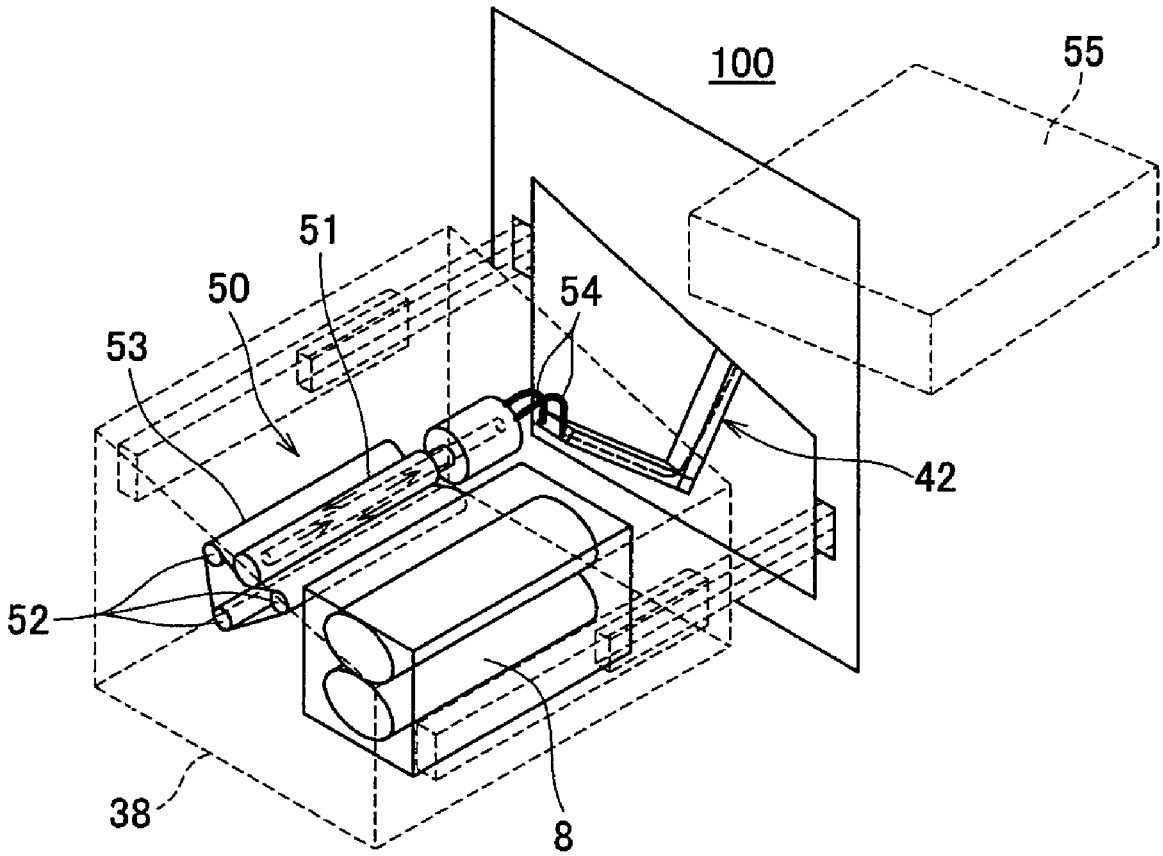
FIG. 15 is a drawing illustrating an example in which a configuration of the present invention is applied to a cooling device which cools a recording sheet.

The cooling device 50 as shown in FIG. 15, includes a cooling roller 51 which is rotatable as a cooling section; a conveying belt 53 which can run around multiple rollers 52 by being stretched around the multiple rollers 52; a cooling medium supply section 55 which includes a pump, a radiator, and a fan; and a connecting member 54 (supply tube and discharge tube) which connects the cooling medium supply section 55 and the cooling roller 51, etc. The cooling medium which is cooled by the cooling medium supply section 55 is arranged to circulate between the cooling roller 51 and the cooling medium supply section 55 via the connecting member 54. Moreover, the cooling device 50, which is arranged downstream in the conveying direction of recording sheet with respect to the fixing device 8, cools, by the cooling device 50, the recording sheet heated up by the fixing device 8. More specifically, a recording sheet passes between the rotating cooling roller 51 and the revolving conveying belt 53, so that heat of the recording sheet is removed and the recording sheet cools down. In this way, a failure such as blocking which occurs due to heating up of the recording sheet may be prevented.

The cooling roller 51 is provided at a pulling out section 38 which can be pulled out with respect to the image forming device body 100. On the other hand, a cooling medium supply section 55 such as a pump is provided at the image forming device body 100. For these features, the same operations and effects can be achieved by applying the features of the embodiments of the present invention. More specifically, the connecting member 54 is arranged with a flexible member and is supported by an extending/contracting supporting unit 42 which can be extended and contracted in the moving direction of the cooling roller 51. This makes it possible to leave the cooling roller 51 and the cooling medium supply section 55 connected by extending the extending/contracting supporting unit 42 even when the cooling roller 51 is being pulled out. Moreover, when the cooling roller 51 is being tucked in, the extending/contracting supporting unit 42 contracts, making it possible to compactly carry the connecting member 54.

Embodiment 8

Figure 16A:
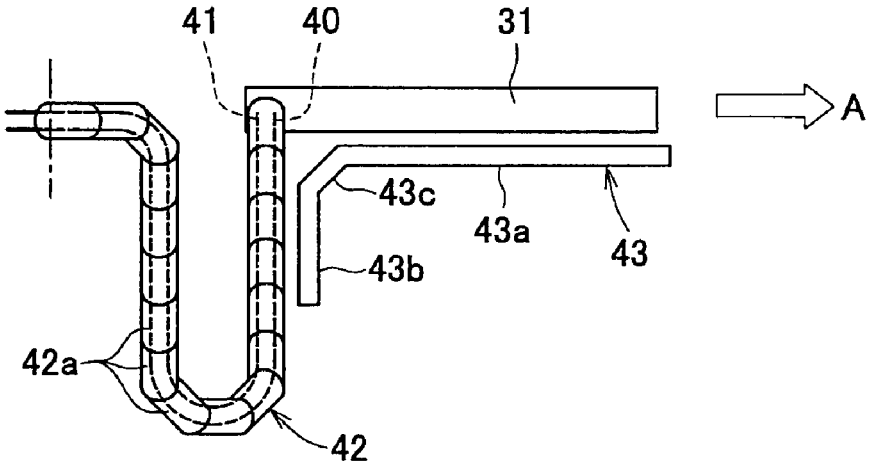
Figure 16B:
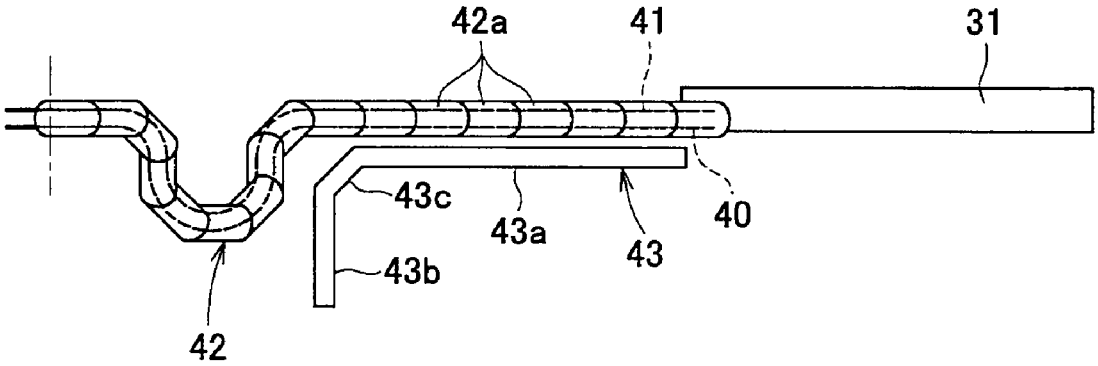

FIGS. 16(*a*) and 16(*b*) are diagrams illustrating a configuration according to Embodiment 8 of the present invention. FIG. 16(*a*) is a lateral view of a heat receiving plate 31 being tucked in and FIG. 16(*b*) is a lateral view of the heat receiving plate 31 being pulled out. Moreover, in FIGS. 16(*a*) and 16(*b*), the fixing device 8, etc. is omitted.

As illustrated in FIGS. 16(*a*) and 16(*b*), a supply tube 40 for supplying the cooling liquid in the heat receiving plate 31 and a discharge tube 41 for discharging the cooling liquid from the heat receiving plate 31 are connected to the heat receiving plate 31. The supply tube 40 and the discharge tube 41 are flow channels which make up a part of the circulation routes 36 as shown in FIG. 2. More specifically, a connecting member which connects the heat receiving plate 31 and the radiator 33 is the supply tube 40, while a connecting member which connects the heat receiving plate 31 and the pump is the discharge tube 41. The supply tube 40 and the discharge tube 41, which are respectively tube-shaped members, are made of a flexible member such as rubber.

The supply tube 40 and the discharge tube 41 are carried within a protective member 42 which is flexibly moveable. The protective member 42 is long-chain shaped, connecting multiple short cylindrically-shaped unit devices 42*a* in a mutually oscillatable manner. The protective member 42 is arranged to be flexibly moveable by each unit device 42*a* oscillating. One end of the protective member 42 is mounted on the heat receiving plate 31 side, while the other end is mounted on the side of the image forming device body (not shown).

Moreover, there is provided a regulating member 43 which regulates the moving range of the protective member 42. In this embodiment, the regulating member 43 has a horizontal section 43*a* which is arranged in the moving direction A (the pulling-out direction) of the heat receiving plate 31, a vertical section 43*b* which is arranged in the direction orthogonal to the horizontal section 43*a*, and an inclined section 43*c* which connects the horizontal section 43*a* and the vertical section 43. The vertical section 43*b* and the inclined section 43*c* are provided at an edge which is opposite the direction A of pulling out the heat receiving plate 31 of the horizontal section 43*a*.

As shown in FIG. 16(*a*), when the heat receiving plate 31 is being tucked in, the protective member 42, and the supply tube 40 and the discharge tube 41 that are carried therein are bending in a U-letter shape. When the heat receiving plate 31 is being pulled out in the direction of the arrow A in FIG. 16(*a*), the protective member 42, the supply tube 40, and the discharge tube 41 move, tracking the heat receiving plate 31. Then, the protective member 42 runs onto the horizontal section 43*a* of the regulating member 43, moving such that it extends to the right side of the figure along the horizontal section 43*a*, as shown in FIG. 16(*b*). Moreover, when the heat receiving plate 31 is being tucked in, the protective member 42, and the supply tube 40 and the discharge tube 41 moves such that they track the movement to the left side of the figure of the heat receiving plate 31, as shown in FIG. 16(*a*).

In this way, as the supply tube 40 and the discharge tube 41 may move, tracking the heat receiving plate 31, the heat receiving plate 31 and the pump 32, etc., can be left connected regardless of whether the heat receiving plate 31 is being tucked in or pulled out. Moreover, as the supply tube 40 and the discharge tube 41 are carried within the protective member 42, collapsing or damaging, etc., of the supply tube 40 and the discharge tube 41 may be prevented. As long as the supply tube 40 and the discharge tube 41 can be carried inside, the protective member 42 does not have to be structured in a manner such that the periphery of the supply tube 40 and the discharge tube 41 is completely covered. In other words, it may be structured such that a part of an external wall of the protective member 42 includes an aperture.

Moreover, when the heat receiving plate 31 is pulled out/tucked in, the moving range of the protective member 42 may be restricted by the regulating member 43. In the embodiment in FIGS. 16(*a*) and 16(*b*), the vertical section 43*b* and the horizontal section 43*a* of the regulating member 43 are provided, making it possible to prevent the protective member from bending below the horizontal section 43*a* and from moving to the right of the vertical section 43*b*. In this way, the moving range of the protective member 42 is regulated to seek a reduction in space, making it possible to prevent a failure from occurring due to the protective member 42 coming into contact with the peripheral equipment.

Moreover, since the regulating member 43 has provided the inclined section 43*c*, it is possible to smoothly conduct an operation of running onto the horizontal section 43*a* of the protective member 42. Furthermore, when the inclined section 43*c* is arranged to be a curved face, it is possible to conduct more smoothly the operation of running onto the protective member 42. Moreover, at least one of the protective member 42 and the regulating member 43 is arranged to include a slidable member, thus reducing friction between the protective member 42 and the regulating member 43, making it possible to more smoothly conduct movement (sliding) of the protective member 42.

Figure 17A:
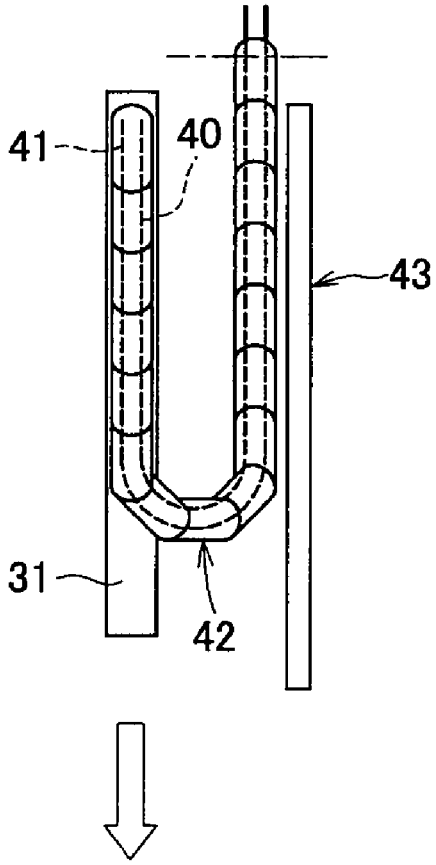
Figure 17B:
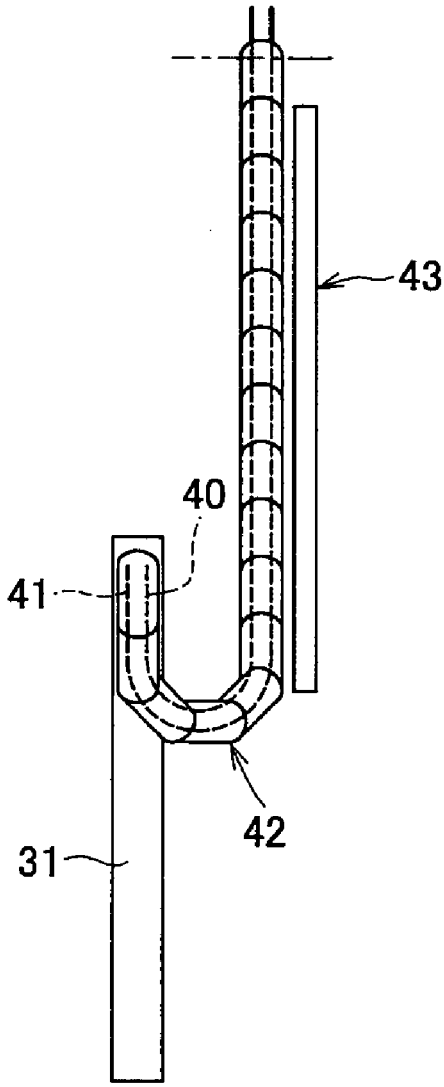

FIGS. 17(*a*) and 17(*b*) are diagrams illustrating a variation of the Embodiment 8. FIG. 17(*a*) is a top or bottom view of a heat receiving plate 31 being tucked in and FIG. 17(*b*) is a top or bottom view of the heat receiving plate 31 being pulled out. The same letter being used as in FIGS. 16(*a*) and 16(*b*) represents the same member.

The regulating member 43 as shown in FIGS. 17(*a*) and 17(*b*) is formed in a straight manner. In this case, the protective member 42 is arranged such that moving to the right side of the figure is regulated by the regulating member 43. Moreover, in FIGS. 17(*a*) and 17(*b*), other features and operations and effects, etc., are the same as what is described in FIGS. 16(*a*) and 16(*b*), so that the explanation is omitted.

Embodiment 9

Figure 18:
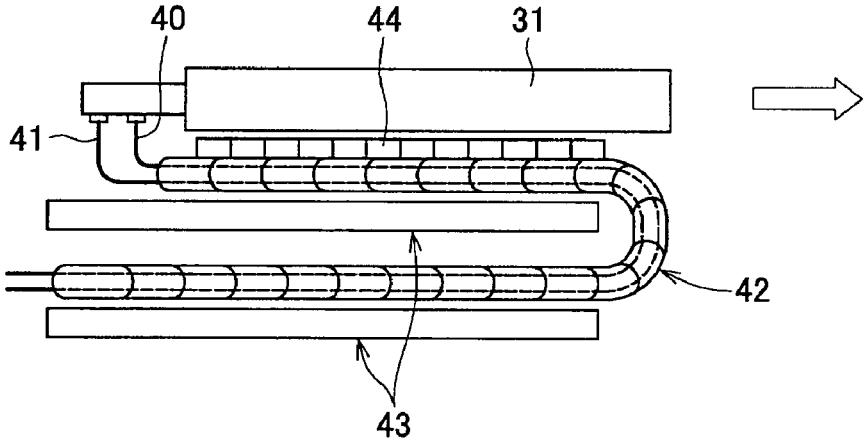
FIG. 18 is a drawing illustrating a configuration according to Embodiment 9 of the present invention.

FIG. 18 is a diagram illustrating a configuration according to Embodiment 9 of the present invention with a lateral view of the heat receiving plate 31 being tucked in. The same letter being used as in FIGS. 16(*a*) and 16(*b*) represents the same member.

In Embodiment 9, a water-absorbing member 44 is provided at a face opposing the heat receiving plate 31 of the protective member 42. In this way, water may be absorbed by the water-absorbing member 44 even when condensation occurs at the heat receiving plate 31 or when water leakage occurs, making it possible to suppress water from adhering to another unit within the image forming device. Moreover, in the Embodiment 9, other features, operations and effects, etc., are the same as what is described in the Embodiment 8, so that the explanation is omitted.

In the embodiments of the present invention, a cooling device which cools a fixing device has been explained, but the features of the present invention are also applicable to a cooling device which cools a body to be cooled, the body being something other than the fixing device. For example, FIG. 19 shows an example in which the features of the present invention are applied to a cooling device which cools a recording sheet.

Figure 19:
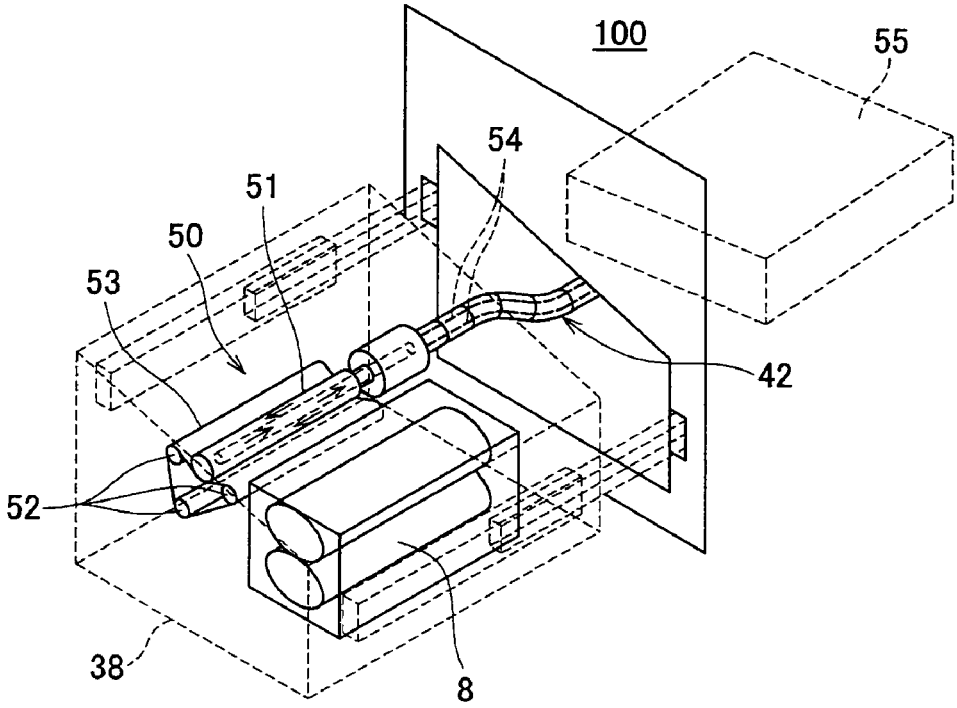
FIG. 19 is a drawing illustrating an example in which a configuration of the present invention is applied to a cooling device which cools a recording sheet.

The cooling device 50, as shown in FIG. 19, includes a cooling roller 51 which is rotatable as a cooling section; a conveying belt 53 which can run around multiple rollers 52 by being stretched around the multiple rollers 52; a cooling medium supply section 55 which includes a pump, a radiator, and a fan, etc.; and connecting members 54 (supply tube and discharge tube) which connect the cooling medium supply section 55 and the cooling roller 51. The cooling medium which is cooled by the cooling medium supply section 55 is arranged to circulate between the cooling roller 51 and the cooling medium supply section 55 via the connecting member 54. Moreover, the cooling device 50, which is arranged downstream in the conveying direction of recording sheet with respect to the fixing device 8, cools the recording sheet heated up by the fixing device 8. More specifically, a recording sheet passes between the rotating cooing roller 55 and the revolving conveying belt 53, so that heat of the recording sheet is removed by the cooling roller 51 and the recording sheet cools down. In this way, a failure such as blocking which occurs due to heating up of the recording sheet may be prevented.

The cooling roller 51 is provided at a pulling out section 38 which can be pulled out with respect to the image forming device body 100. On the other hand, a cooling medium supply section 55 such as a pump is provided at the image forming device body 100. For these features, the same operations and effects can be achieved by applying the features of the embodiments of the present invention. More specifically, the connecting member 54 is arranged with a flexible member and the connecting member 54 is carried in the protective member 42 as described above. This makes it possible to leave the cooling roller 51 and the cooling medium supply section 55 connected even when the cooling roller 51 is being pulled out. Moreover, as the connecting member 54 is carried within the protective member 42, collapsing or damaging of the connecting member 54 may be prevented.

Furthermore, in the embodiment shown in FIG. 19, a regulating member which regulates the moving range of the protective member 42 and a water-absorbing member which absorbs water produced at the cooling roller 51 may be provided.

Moreover, the protective member 42 is not limited to what is arranged by connecting multiple unit devices to be mutually oscillatable. For example, the protective member 42 may be arranged with a bellow-shaped tubular member.

Moreover, while the features of the present invention are applied to a cooling device which has a cooling section moveable between a tucked-in state and a pulled-out state, the locations between which the cooling section is moved are not limited in the present invention to the locations of tucked-in and pulled-out states. In other words, the features of the present invention are applicable to a cooling device which includes a cooling section which is arranged to be moveable with respect to the image forming device body between a first location and a second location which is different from the first location; a cooling medium supply section which is provided such that it does not move integrally with the cooling section; and a connecting member which connects the cooling section and the cooling medium supply section. In this way, the cooling section and the cooling medium supply section can be left connected even when the cooling section is located at either one of the first location and the second location.

Moreover, the image forming device which is provided with the cooling device of the present invention is not limited to what is shown in FIG. 1. Other copiers, printers, facsimile machines, or multi-functional unit having these functions may be provided with the cooling device of the present invention.

As described above, according to the present invention, regardless of whether a cooling section such as a heat receiving plate is in a tucked-in state (first location) or a pulled-out state (second location), a cooling section and a cooling medium supply section such as a pump may be left connected, making it possible to prevent a contaminant from finding its way into the flow channel. In this way, degradation of the cooling liquid and a possibility of failure of the pump, etc., may be prevented. Moreover, while the cooling liquid which remains in the connecting section (the separating section) of the cooling pipe drops into the image forming device when a cooling pipe is separated in the conventional cooling device, this is not the case here so that there is no possibility of causing a detrimental effect on image forming.

Moreover, even when the cooling unit is being pulled out of the image forming device body, the cooling liquid can be supplied to the cooling section, making it possible to continuously cool the cooling section and the peripheral members. For example, when the cooling section is provided at the fixing device, process unit, or the intermediate transfer belt, etc., cooling can be conducted continuously even when the fixing device, etc. is being pulled out, making it possible to conduct maintenance and paper jamming processes with the temperature of the fixing device, etc., being lowered, leading to superior security. Moreover, when the cooling section is a cooling roller for the recording sheet, etc., cooling is continuously conducted even when the cooling roller is being pulled out, making it possible to efficiently conduct cooling of the recording sheet. Furthermore, the pump and the radiator, etc, may be provided at the image forming device body by adopting the features of the present invention, making it possible to prevent the device from becoming large.

Moreover, the connecting members (supply tube and discharge tube) which connect the cooling section and the cooling medium supplying section are supported by an extending/contracting supporting unit which can be extended and contracted in the moving direction of the cooling section, making it possible to smoothly and stably conduct the tracking operation of the connecting member in conjunction with the moving of the cooling section. Moreover, as in the above embodiments, the extending/contracting supporting unit is arranged to include multiple arm members which are oscillatably connected via the joint section, making it possible to conduct extending/contracting operations in a reduced space and to compactly carry the connecting members.

Furthermore, the connecting members (supply tube and discharge tube) which circulate the cooling liquid are carried within the protective member, making it possible to prevent collapsing and damaging, etc., of the connecting members, so that it is made possible to smoothly and stably circulate the cooling liquid and to provide a highly reliable device.

The present application is based on the Japanese Priority Applications No. 2009-198356 and No. 2009-198359, both filed on Aug. 28, 2009, the entire contents of which are hereby incorporated by reference.

The invention claimed is:

1. A cooling device, comprising:

a cooling section which is moveably provided with respect to an image forming device body between a first location and a second location, the second location being different from the first location, and which cools surroundings with a cooling medium to be supplied;

a cooling medium supply section which is provided at the image forming device body and which cools the cooling medium to supply the cooled cooling medium to the cooling section;

a connecting member which connects the cooling section and the cooling medium supply section to circulate the cooling medium between the cooling section and the cooling medium supply section, the connecting member includes a flexible member and is supported by a guiding member which guides an operation of tracking the connecting member in conjunction with movement of the cooling section, the guiding member is a protective member which is arranged to connect multiple unit devices such that the multiple unit devices are mutually oscillatable, and the connecting member is carried within the protective member; and a water-absorbing member on a face of the protective member, which face opposes the cooling section.

2. The cooling device as claimed in claim 1, further comprising a regulating member which contacts the protective member to restrict a moving range of the protective member.

3. The cooling device as claimed in claim 1, wherein at least one of the protective member and the regulating member includes a sliding member.

4. The cooling device as claimed in claim 1, wherein the cooling section is arranged to be a cooling roller which contacts a recording medium onto which an image is fixed to cool the recording medium.

5. An image forming device, comprising the cooling device as claimed in claim 4.

6. An image forming device, comprising the cooling device as claimed in claim 1.

7. A cooling device, comprising:

a cooling section which is moveably provided with respect to an image forming device body between a first location and a second location, the second location being different from the first location, and which cools surroundings with a cooling medium to be supplied;

a cooling medium supply section which is provided at the image forming device body and which cools the cooling medium to supply the cooled cooling medium to the cooling section;

a connecting member which connects the cooling section and the cooling medium supply section to circulate the cooling medium between the cooling section and the cooling medium supply section;

a protective member to protect the connecting member; and a water-absorbing member disposed on a face of the protective member, wherein the protective member is arranged to connect multiple unit devices such that the multiple unit devices are mutually oscillatable, and the connecting member is carried within the protective member, and the face of the protective member opposes the cooling section.

8. A cooling device, comprising:

a cooling section which is moveably provided with respect to an image forming device body between a first location and a second location, the second location being different from the first location, and which cools surroundings with a cooling medium to be supplied;

a cooling medium supply section which is provided at the image forming device body and which cools the cooling medium to supply the cooled cooling medium to the cooling section;

a connecting member which connects the cooling section and the cooling medium supply section to circulate the cooling medium between the cooling section and the cooling medium supply section;

a protective member to protect the connecting member; and a water-absorbing member disposed between the protective member and the cooling section, wherein the protective member is arranged to connect multiple unit devices such that the multiple unit devices are mutually oscillatable, and the connecting member is carried within the protective member, and the water-absorbing member is disposed on a face of the protective member that opposes the cooling section.

* * * * *